US009073024B2

(12) United States Patent
Drewry et al.

(10) Patent No.: US 9,073,024 B2
(45) Date of Patent: Jul. 7, 2015

(54) MIXING BUBBLE GENERATOR AND INSTALLATION CONFIGURATION

(71) Applicants: Kristinn G. Drewry, Bellevue, WA (US); Richard J. Koopmans, Oroville, WA (US); William A. Arnold, Akron, OH (US)

(72) Inventors: Kristinn G. Drewry, Bellevue, WA (US); Richard J. Koopmans, Oroville, WA (US); William A. Arnold, Akron, OH (US)

( * ) Notice: Subject to any disclaimer, the term of this patent is extended or adjusted under 35 U.S.C. 154(b) by 323 days.

(21) Appl. No.: 13/830,455

(22) Filed: Mar. 14, 2013

(65) Prior Publication Data

US 2014/0016430 A1 Jan. 16, 2014

Related U.S. Application Data

(60) Provisional application No. 61/741,313, filed on Jul. 16, 2012.

(51) Int. Cl.
*B01F 13/02* (2006.01)

(52) U.S. Cl.
CPC ..... *B01F 13/02* (2013.01); *B01F 13/0222* (2013.01); *B01F 13/0255* (2013.01); *B01F 13/0283* (2013.01)

(58) Field of Classification Search
CPC ..... B01F 3/0412; B01F 13/0255
USPC ..... 366/101, 106, 107
See application file for complete search history.

(56) References Cited

U.S. PATENT DOCUMENTS

| | | | | |
|---|---|---|---|---|
| 4,064,750 | A * | 12/1977 | Speece | 73/861.21 |
| 5,325,725 | A * | 7/1994 | Sanderson et al. | 73/861.21 |
| 8,871,498 | B2 * | 10/2014 | Liu | 435/287.5 |

* cited by examiner

*Primary Examiner* — David Sorkin
(74) *Attorney, Agent, or Firm* — Anthony Claiborne

(57) ABSTRACT

A new accumulator for generating mixing bubbles comprises pivoting, counterbalanced buckets, the buckets receiving air directed from blowers, either directly from injectors connected to the blowers, or from diffusers used for aeration of the liquid in the tank. A bucket, weighed down by a counterbalance, receives air from injectors or diffusers below, and, as the air displaces liquid in the bucket, the buoyancy of the bucket increases until it exceeds the downward force of the counterweight, at which time the bucket pivots upward to release a large mixing bubble into the tank. An assembly for installation of the accumulator affixes the accumulator on a rigid vertical piece depending from a horizontal bridge.

3 Claims, 5 Drawing Sheets

MIXING BUBBLE GENERATOR AND INSTALLATION CONFIGURATION

BACKGROUND OF THE INVENTION

1. Field of the Invention

This invention relates to an apparatus for generating large bubbles for mixing liquids stored in tanks. More specifically, this invention relates to a pivoting counterweighted bubble accumulator utilizing streaming sources of gas to create large mixing bubbles. Further, this invention relates to a configuration permitting retrofitting tanks with bubble accumulators without a need to decommission and drain the tank.

2. Description of the Related Art

It is known that it is desirable periodically to mix drinking water stored in large tanks, such as municipal water supplies, in order to reduce the likelihood of localized stagnation in such tanks. Large mixing bubbles, from 6 inches to three feet or greater in diameter, propagated through such tanks, such as described in U.S. Pat. No. 8,192,069, can advantageously provide the required mixing to prevent stagnation.

Further, in wastewater treatment, it is known that it is desirable to mix or agitate the liquid in both aerobic and anoxic stages of treatment to promote the conversion processes leading to water purification. Here also, large mixing bubbles of 6 inches to three feet or greater in diameter can advantageously provide the requisite mixing, as described in U.S. Pat. No. 7,282,141.

Large bubbles for mixing liquids in tanks have heretofore been provided by means of an accumulator, such as the large bubble-forming plates described in U.S. Pat. No. 4,595,296 to Parks, receiving relatively large volumes of air or compressed gas, typically supplied by an air compressor, the gas accumulating under and then erupting around the plate accumulator to form the large mixing bubbles. It is a limitation of the prior art that such methods require an air compressor, typically with a fairly large motor of three horsepower or greater, to supply the volume and pressure of gas necessitated by the accumulator design in order to create sufficiently large mixing bubbles.

It is desirable to create sufficiently large mixing bubbles using an air source that is more energy efficient than the air compressor required by the prior art. Simple blowers, such as those already in use to create small aeration bubbles in the aerobic treatment of wastewater utilize motors on the order of one horsepower, are significantly more energy efficient than the air compressors used in the prior art generation of large mixing bubbles. If an accumulator can use the air from blowers in aerobic treatment facilities, no additional source of air is needed for the accumulator in such applications. In any case, it is desirable to have an accumulator apparatus that can utilize such blowers, rather than air compressors, as the source of air for generating large mixing bubbles.

Prior art bubble mixers, such as U.S. Pat. Nos. 4,595,296 and 6,629,773 to Parks, require installation of accumulators in the bottom of the target tanks, a process entailing the decommissioning and draining of the tank when the tank is retrofitted with the bubble mixers. It is desirable to have a bubble mixer configuration that enables the retrofitting of existing tanks without requiring the tank to be drained.

Described herein below are accumulators that can utilize air supplied by blowers to generate large mixing bubbles. Also described below is a bubble mixer configuration that can be used with either prior art accumulators or the newly invented accumulators described herein to retrofit an existing tank without requiring the draining of the tank.

BRIEF DESCRIPTION OF THE INVENTIVE MATTER

A new accumulator for generating mixing bubbles comprises pivoting, counterbalanced buckets, the buckets receiving air directed from blowers, either directly from injectors connected to the blowers, or from diffusers used for aeration of the liquid in the tank. A bucket, weighed down by a counterbalance, receives air from injectors or diffusers below, and, as the air displaces liquid in the bucket, the buoyancy of the bucket increases until it exceeds the downward force of the counterweight, at which time the bucket pivots upward to release a large mixing bubble into the tank. The air thus having been released, the bucket is no longer buoyant and therefore pivots downward, weighed down by the counterbalance, to receive air again and repeat the process.

In an alternative embodiment, the device comprises two buckets joined bottom to bottom to form a roughly cylindrical object with openings at both ends and a solid divider in the middle. The device further comprises a pivot connected to the buckets at the point of their junction, enabling the conjoined buckets to rotate about the pivot point. Yet further, sliding weights are connected to the apparatus to provide additional torque to the pivoting buckets at certain points in rotation of the buckets around the pivot point. In operation, the device is positioned over a source of air and the rotational position of the buckets is such that a first bucket is inverted, receiving air, while the second bucket is upright and filled with the surrounding liquid. As air accumulates in the first bucket, it gains buoyancy, forcing the conjoined buckets to begin rotation about the pivot point. The sliding weights are configured so that, at a critical point in the upward pivoting of the first bucket, the weights slide to provide additional torque to the pivoting buckets, resulting in a sudden rotation of the conjoined buckets to position the first bucket with its opening substantially at its highest point, rapidly releasing the air accumulated in the first bucket in the form of a large mixing bubble. The second bucket is now positioned over the source of air, and the process begins again with the second bucket receiving air, accumulating air and gaining buoyancy, rotating upward and then rapidly releasing a large bubble when rotation is rapidly advanced by torque from the sliding weights.

A new configuration for accumulators, adapted either to prior art accumulators or to the pivoting accumulator of the present invention, allows installation of accumulators for the production of large mixing bubbles in existing tanks without requiring draining of the tank. In this configuration, a bridge piece traverses the top of the tank horizontally. Depending from this horizontal bridge piece is a rigid vertical piece that extends downward into the tank, terminating close to the bottom of the tank. Attached to the vertical piece near its bottom are accumulators receiving air from the air supply, the accumulators retained by the vertical piece at such a position and depth for producing effective mixing bubbles. The air supply for the accumulators is provided from the top of the tank through the vertical piece, whereby it is connected to the accumulators.

BRIEF DESCRIPTION OF THE DRAWINGS

The foregoing objects, as well as further objects, advantages, features and characteristics of the present invention, in addition to methods of operation, function of related elements of structure, and the combination of parts and economies of manufacture, will become apparent upon consideration of the following description and claims with reference to the accompanying drawings, all of which form a part of this specification, wherein like reference numerals designate corresponding parts in the various figures, and wherein:

DETAILED DESCRIPTION OF THE PREFERRED EMBODIMENTS

Figure 1:
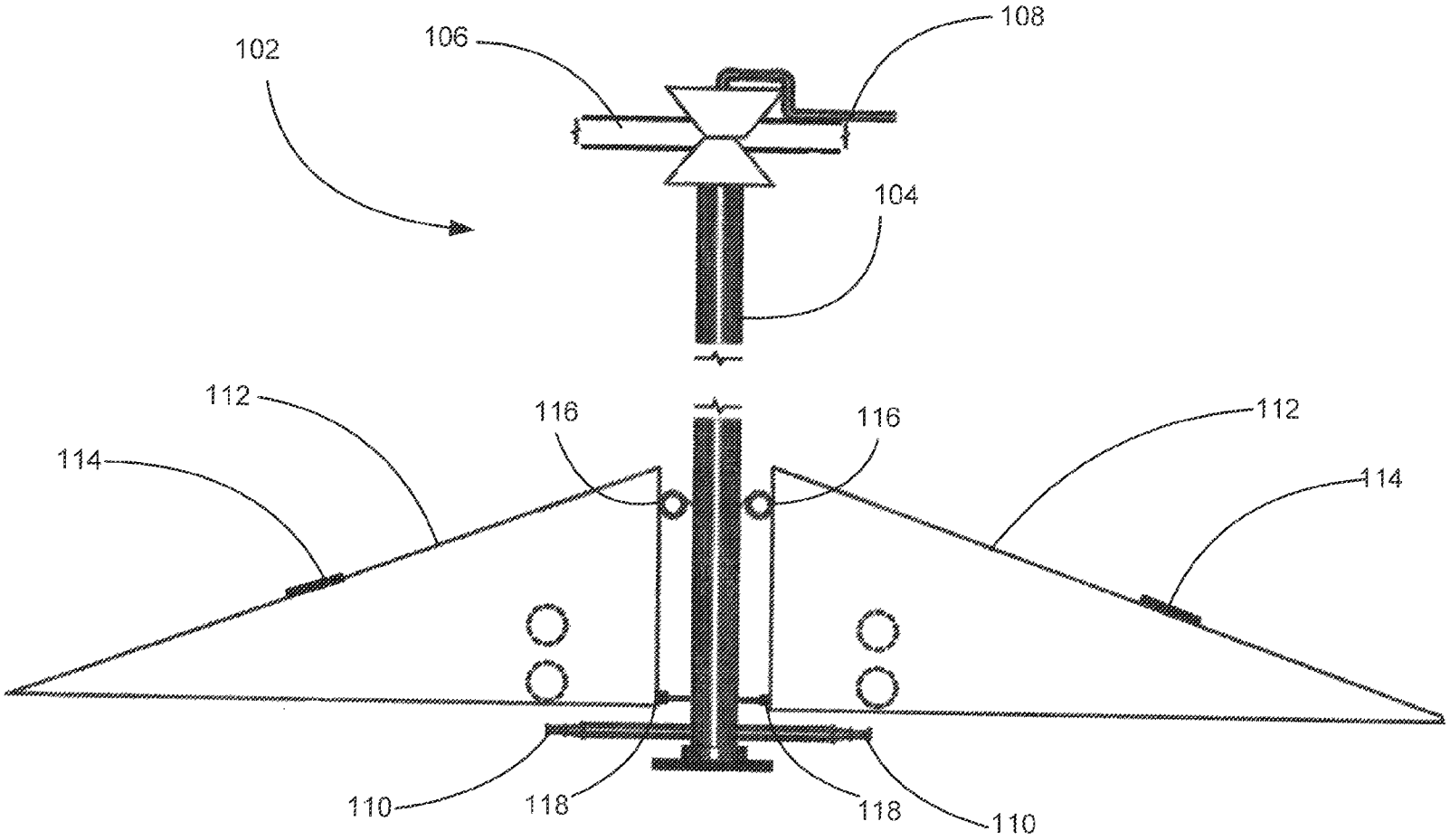
FIG. 1 is an elevation view of an embodiment of the present invention.

FIG. 1 depicts an embodiment of the invention 102, wherein a vertical tubular piece 104 depends from a horizontal bridge piece 106. The horizontal bridge piece 106 may be any rigid bar, such as a metal I-beam, spanning across the top of the tank. In the depicted embodiment, the tubular vertical piece 104 receives a supply line 108 with air in at its top. The supply line 108 runs through the tubular vertical piece 104 down to air injectors 110 extending from the vertical piece 104 from its bottom. Air bucket accumulators 112 with counterweights 114 are pivotally attached to the vertical piece 104 with pivoting connectors 116 and are normally retained against the vertical piece 104 by stops 118. Air enters the air buckets 112 from the air injectors 110.

Figure 2:
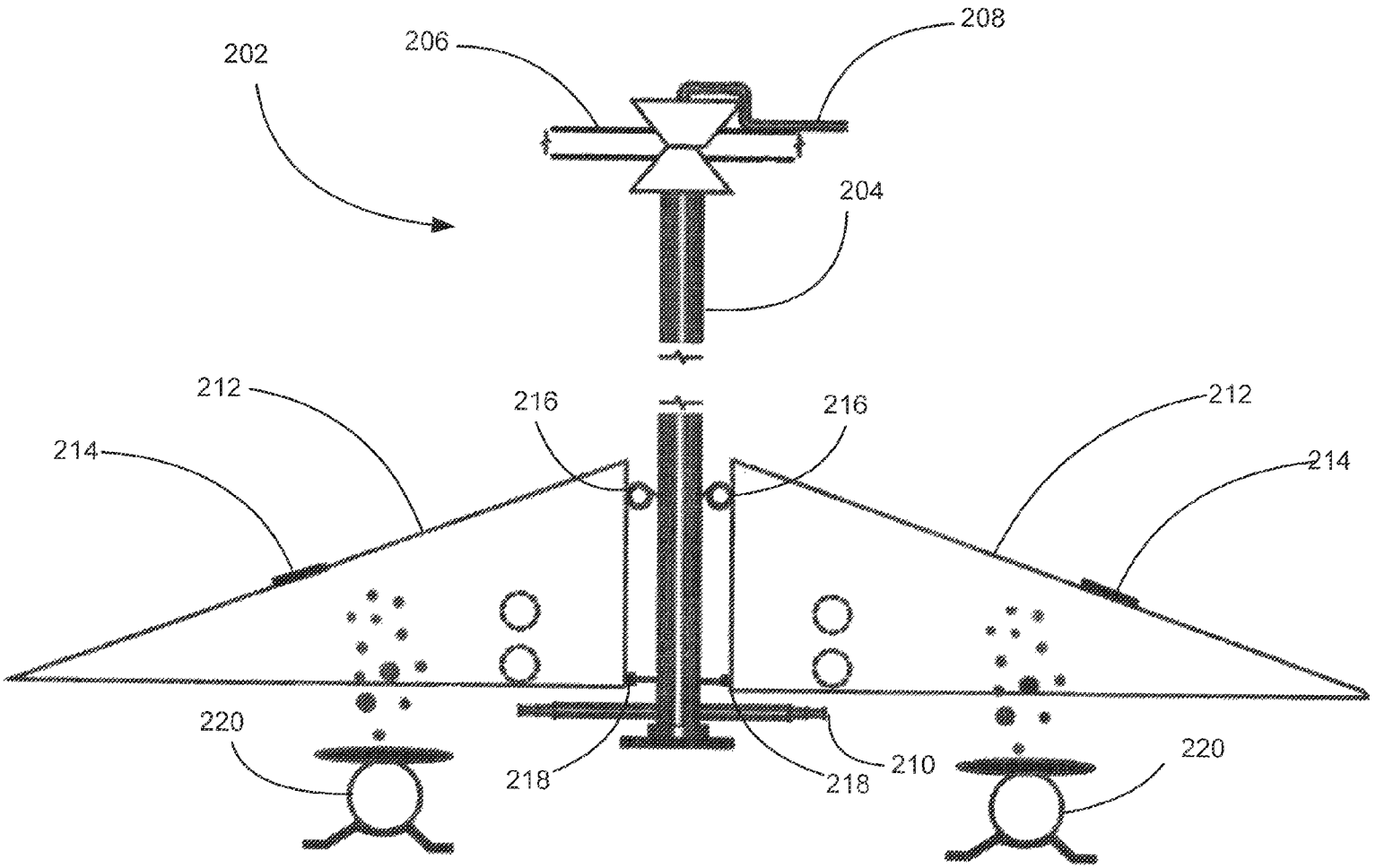
FIG. 2 is an elevation view of an embodiment of the invention in an aerobic wastewater treatment tank with diffusers.

FIG. 2 depicts another embodiment of the invention 202, deployed as in an aeration tank for wastewater treatment. In this depiction, the air buckets 212 receive air both from air injectors 210 (only one labeled for clarity) and from the diffusers 220 which are normally present in aerobic treatment tanks for aeration of the processing liquid. While not so depicted herein, it will be clear to those of skill in the art that air can be supplied to the diffusers from the supply line 208 running through the vertical piece 204 for the air injectors 210.

Figure 3:
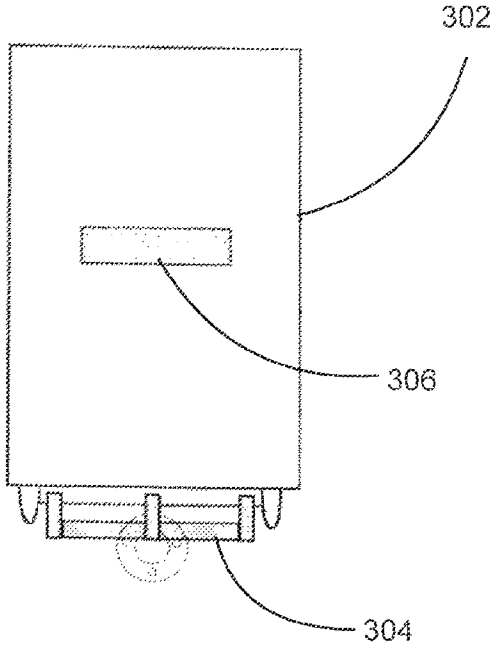
FIG. 3 is an overhead view of one air-receiving bucket in an embodiment of the invention.

FIG. 3 is an overhead view of the air bucket or accumulator 302 in an embodiment of the invention, showing the pivot hinge 304 and counterweight 306 employed by the invention.

Figure 4:
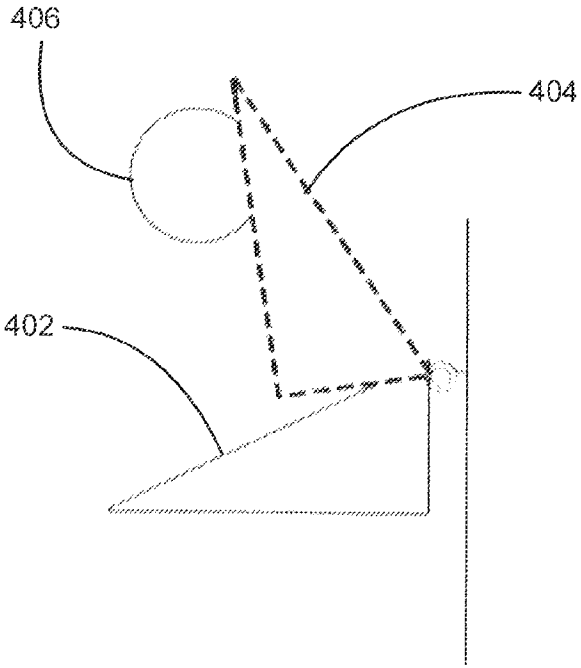
FIG. 4 is a diagram of the action of an air-receiving bucket on obtaining sufficient air to cause buoyancy leading to discharge of a large mixing bubble.

FIG. 4 shows the action of the invention, with the normal, air-receiving position of the bucket accumulator 402 shown in solid line and the buoyed, air-releasing position of the bucket accumulator 404 in dotted line, a large mixing bubble 406 released to mix the tank.

Figure 5B:
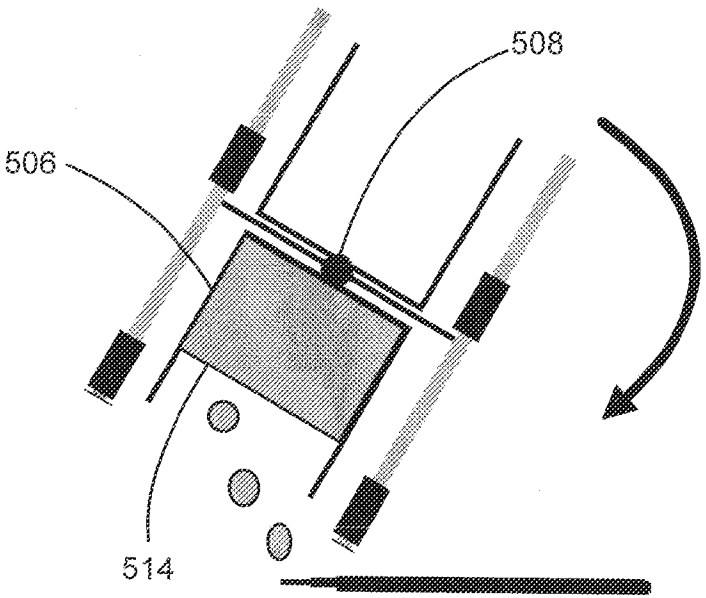
FIGS. 5*a*-5*d* are diagrams of the operation of an alternative embodiment of the invention.
Figure 5A:
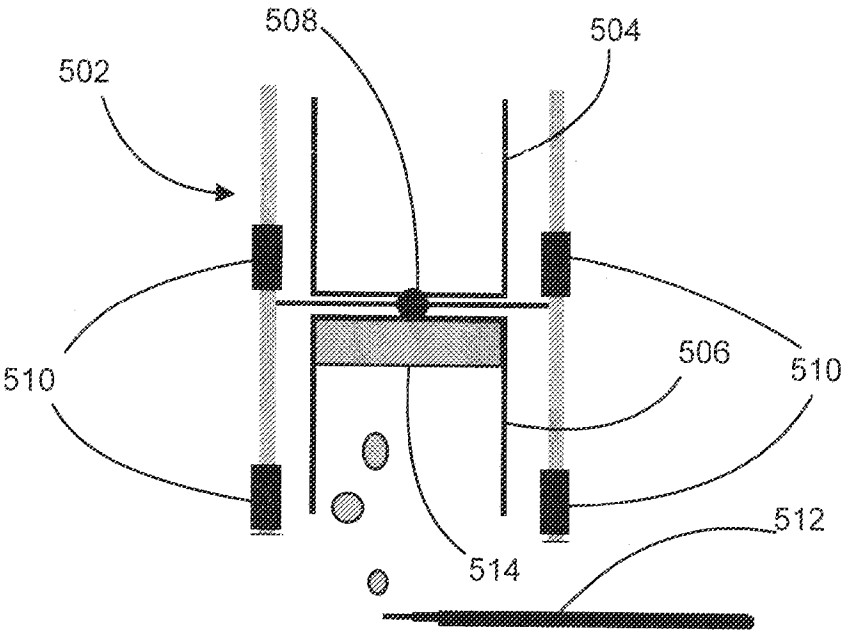

FIGS. 5*a*-5*d* depict an alternative embodiment of the invention. FIG. 5 depicts the invention 502 as two buckets, 504, 506 joined bottom to bottom to form a roughly cylindrical object with openings at the top and at the bottom and a solid divider in the middle. The device further comprises a pivot 508 connected to the buckets at the point of their junction, enabling the conjoined buckets to rotate about the pivot point. Yet further, sliding weights 510 are connected to the apparatus to provide additional torque to the pivoting buckets at certain points in rotation of the buckets around the pivot point. In operation, the device is positioned over a source of air 512 and the rotational position of the buckets is such that the lower bucket is inverted, receiving air, while the upper bucket is upright and filled with the surrounding liquid. In FIG. 5*a*, the lower bucket is 506 and already partially full of air 514. Sliding counterweights 510 are positioned toward bucket 506 and away from bucket 504.

In FIG. 5*b*, lower bucket 506 now contains more air 514 from source 512, creating sufficient buoyancy in bucket 506 to initiate rotation of the apparatus 502 about pivot 508 in the direction indicated by the heavy curved arrow.

Figure 5D:
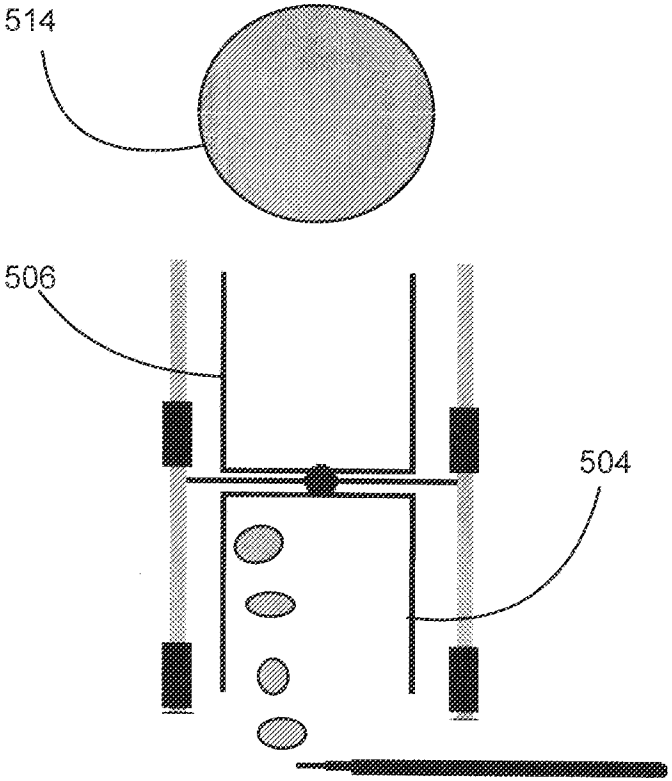
Figure 5C:
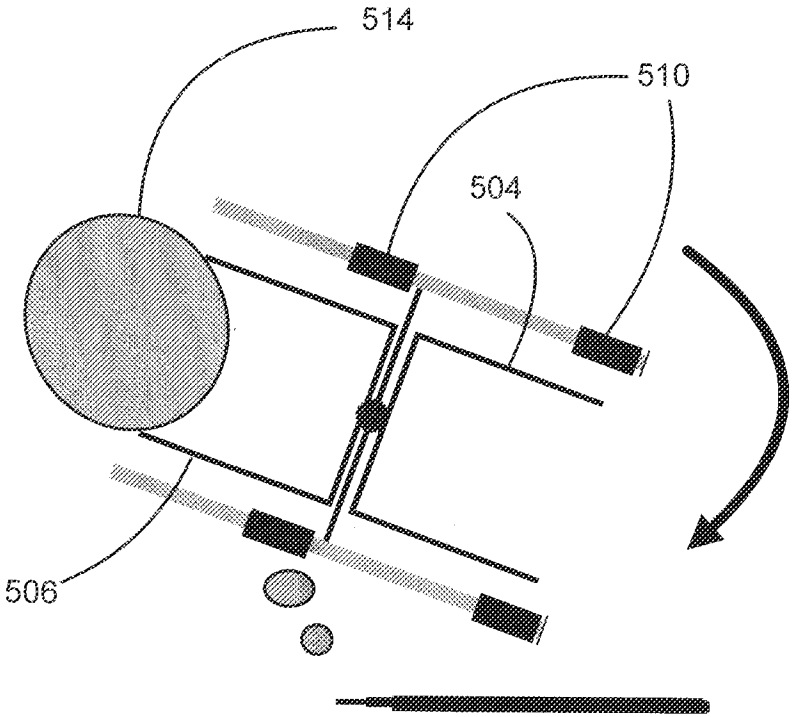

In FIG. 5*c*, apparatus 502 has further rotated about the pivot in the direction of the heavy curved arrow, with the effect that sliding counterweights 510 have slid away from bucket 506 toward bucket 504. At this point, with bucket 506 trending toward an upright position, air 514 contained in bucket 506 is released from bucket 506.

In FIG. 5*d*, air 514 has been released from bucket 506 as a large bubble. Sliding counterweights 510 are positioned toward bucket 504, which is now in the lower position to receive air from source 512, repeating the cycle.

While a particular design of pivoting accumulator is depicted herein, it will be clear to those of skill in the art that numerous other designs may be employed for a pivoting, counterbalanced accumulator in keeping with the spirit of the present invention. The present invention is intended to cover any form of accumulator for the production of large mixing bubbles in tanks, wherein the accumulator is pivoted and counterweighted, relying on increasing buoyancy on accumulation of air to cause a sudden uplifting pivot of the accumulator in which a large mixing bubble is released.

Furthermore, as shown in FIGS. 1 and 2, the accumulator is placed and retained within the tank by way of the vertical piece depending from a bridge, with the air supply line for the accumulator running along the vertical piece. As will be clear to those of skill in the art, this arrangement can be used to fit a tank with any kind of accumulator for large bubbles, such as that described in reference to FIGS. 5*a*-*e* and is not limited to the deployment of pivoting counterweighted accumulators such as described herein in reference to FIGS. 1 and 2. Advantageously, this arrangement can be used to retrofit many tank configurations for bubble mixing without a need to drain the tank for placement of the accumulators.

Although the detailed descriptions above contain many specifics, these should not be construed as limiting the scope of the invention but as merely providing illustrations of some of the presently preferred embodiments of this invention. Various other embodiments and ramifications are possible within its scope, a number of which are discussed in general terms above. While the invention has been described with a certain degree of particularity, it should be recognized that elements thereof may be altered by persons skilled in the art without departing from the spirit and scope of the invention. Accordingly, the present invention is not intended to be limited to the specific forms set forth herein, but on the contrary, it is intended to cover such alternatives, modifications and equivalents as can be reasonably included within the scope of the invention. The invention is limited only by the following claims and their equivalents.

We claim:

1. A pivoting bubble accumulator, comprising:

a fixed rotating connector, and a bucket assembly comprising:

substantially identical first bucket and second bucket, each bucket having a volume greater than 255 cubic inches, each bucket having an open end and a bottom, the buckets conjoined at their bottoms, the conjoined buckets rotatingly connected to the rotating connector; and at least one sliding counterweight, the bucket assembly oriented to rotate from a position in which the open end of the first bucket is substantially downward and the open end of the second bucket is substantially upward to a position in which the open end of the first bucket is substantially upward and the open end of the second bucket is substantially downward, and the at least one sliding counterweight is configured to slide toward the lower of the first bucket and the second bucket during operation of the accumulator, the weight of the counterweight being slightly less than the weight of a volume of water filling a bucket.

2. A bubble accumulator assembly, comprising:

a horizontal bridge member comprising a bar;

a rigid tubular vertical member depending down from the horizontal bridge member; and at least one pivoting bubble accumulator affixed to the lower portion of the tubular vertical member.

3. A bubble accumulator assembly according to claim 2, further comprising an air supply for receiving compressed air, the supply running from the upper portion of the rigid tubular vertical member to the lower portion of the rigid tubular vertical member, and air injectors connected to the air supply to receive compressed air, the air injectors affixed to the rigid tubular vertical member to supply air to the at least one pivoting bubble accumulator.

* * * * *